US008215500B2

(12) United States Patent
Constantine

(10) Patent No.: US 8,215,500 B2
(45) Date of Patent: Jul. 10, 2012

(54) HANGING DEVICE FOR RESEALABLE STORAGE BAGS

(75) Inventor: Douglas Constantine, Chicago, IL (US)

(73) Assignee: Sears Brands, L.L.C.

( * ) Notice: Subject to any disclaimer, the term of this patent is extended or adjusted under 35 U.S.C. 154(b) by 323 days.

(21) Appl. No.: 12/500,924

(22) Filed: Jul. 10, 2009

(65) Prior Publication Data

US 2011/0006021 A1 Jan. 13, 2011

(51) Int. Cl.
*A47G 29/00* (2006.01)

(52) U.S. Cl. ..... 211/85.15

(58) Field of Classification Search ..... 211/85.15, 211/42, 12, 46; 248/95; 24/303, 304; 40/658
See application file for complete search history.

(56) References Cited

U.S. PATENT DOCUMENTS 3,600,764 A * 8/1971 Froehlich ..... 24/545
4,641,756 A * 2/1987 Brown ..... 211/85.3
4,787,522 A * 11/1988 Nocek et al. ..... 211/85.15
4,832,290 A * 5/1989 Baglio ..... 248/95
4,998,630 A * 3/1991 Schwartz ..... 211/85.15
5,102,076 A * 4/1992 North et al. ..... 248/95
5,394,993 A * 3/1995 Gravell et al. ..... 211/12
5,467,949 A * 11/1995 Lemke ..... 248/95
5,603,417 A * 2/1997 Blair ..... 211/85.15
5,680,938 A * 10/1997 Rubinstein ..... 211/42
5,715,949 A * 2/1998 Rutledge ..... 211/47
6,209,734 B1 * 4/2001 Wang ..... 211/87.01
6,213,316 B1 * 4/2001 Gretz ..... 211/113
6,530,488 B1 * 3/2003 Krammes, Jr. ..... 211/85.29
D479,683 S * 9/2003 Turvey et al. ..... D8/373
6,648,153 B2 * 11/2003 Holmes ..... 211/85.15
7,121,030 B2 * 10/2006 Schneider ..... 40/661
7,487,611 B2 * 2/2009 Robb ..... 40/658
7,793,791 B1 * 9/2010 Pouille ..... 211/46
D642,913 S * 8/2011 Osborn et al. ..... D9/435
2006/0043037 A1 * 3/2006 Suzuki ..... 211/85.15
2011/0006021 A1 * 1/2011 Constantine ..... 211/85.15

* cited by examiner

*Primary Examiner* — Sarah Purol
(74) *Attorney, Agent, or Firm* — McAndrews, Held & Malloy, Ltd.

(57) ABSTRACT

An embodiment of the present invention is directed to a device for hanging a storage bag having a resealable mechanical seal. The device includes an elongate body. The body includes at least two opposing flaps, a longitudinal slit passing a distance between the opposing flaps and having a width that is narrower than the mechanical seal of the storage bag, and a tapered opening at an edge of the body. The tapered opening is adapted to guide a leading edge of the storage bag that is below the mechanical seal into the slit.

14 Claims, 11 Drawing Sheets

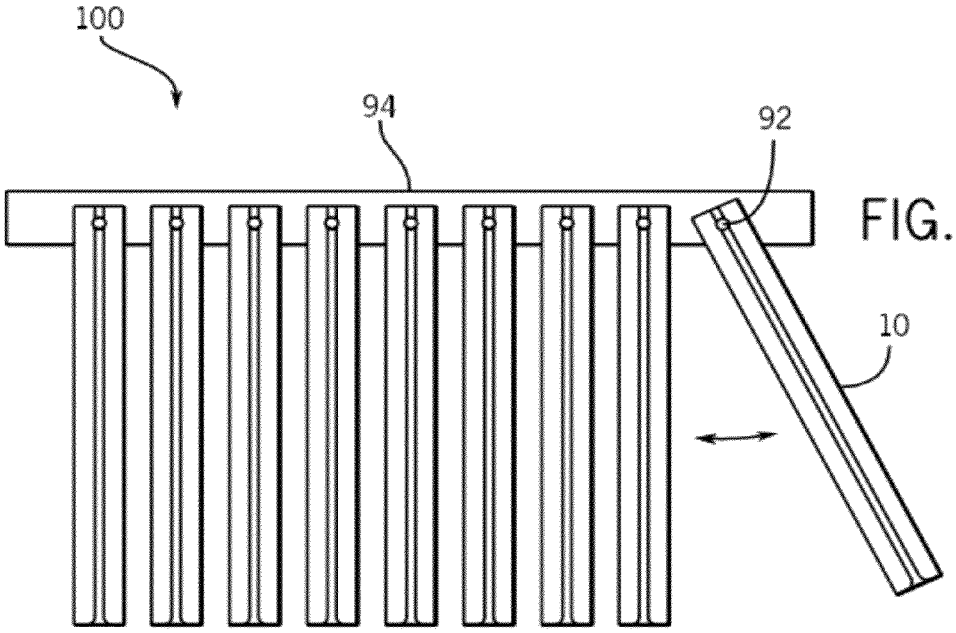
FIG. 7A
FIG. 7B
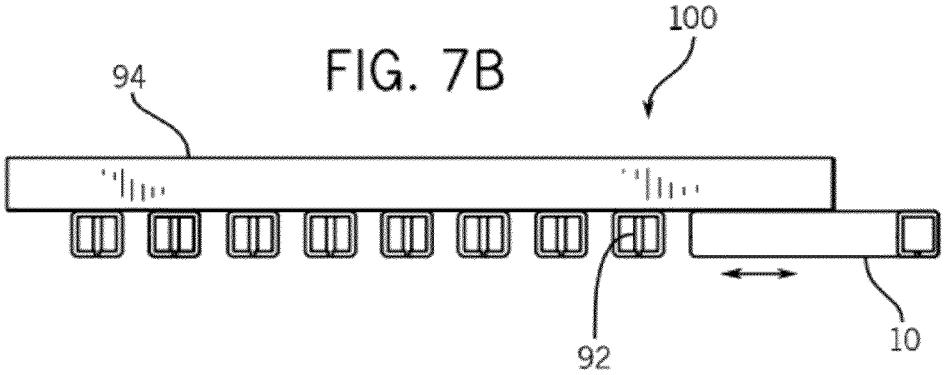

HANGING DEVICE FOR RESEALABLE STORAGE BAGS

BACKGROUND

Resealable storage bags with mechanical closure means, such as those described in U.S. Pat. No. 5,403,094, the disclosure of which is hereby incorporated by reference, are widely used in today's households. They can be used to store both food and non-food items. They are often used to store smaller servings of food items in a refrigerator or a freezer.

One drawback of such resealable bags is that when full, they themselves can consume a disproportionate amount of shelf space when stored in cupboard, pantry, refrigerator, freezer, or the like. This is due to the fact when these bags are stored, they often lie flat. It is often undesirable to stack other items on top of these bags, because that may result in flattening on the item(s) stored in the bag, or the added weight may force the bag open, thereby spilling its contents (e.g. spaghetti) on the shelf. Moreover, it will be appreciated that while a resealable bag lies flat on a shelf, the vertical space above the bag is essentially wasted.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

An embodiment of the present invention is directed to a device for hanging a storage bag having a resealable mechanical seal. The device includes an, elongate body. The body includes at least two opposing flaps, a longitudinal slit passing a distance between the opposing flaps and having a width that is narrower than the mechanical seal of the storage bag, and a tapered opening at an edge of the body. The tapered opening is adapted to guide a leading edge of the storage bag that is below the mechanical seal into the slit.

The above device may be installed within, for example, a refrigerator, a cupboard, or the like. Also, several of the above devices may be attached to form a system of hanging devices.

BRIEF DESCRIPTION OF THE DRAWINGS

The accompanying drawings, which are incorporated in and form a part of this specification, illustrate embodiments of the invention and, together with the description, serve to explain the principles of embodiments of the invention:

FIG. 7A is a bottom view of a resealable storage bag hanging system, in accordance with an embodiment of the present invention;

FIG. 7B is a front view of the resealable storage bag hanging system of FIG. 7A, in accordance with an embodiment of the present invention;

DETAILED DESCRIPTION

Figure 1A:
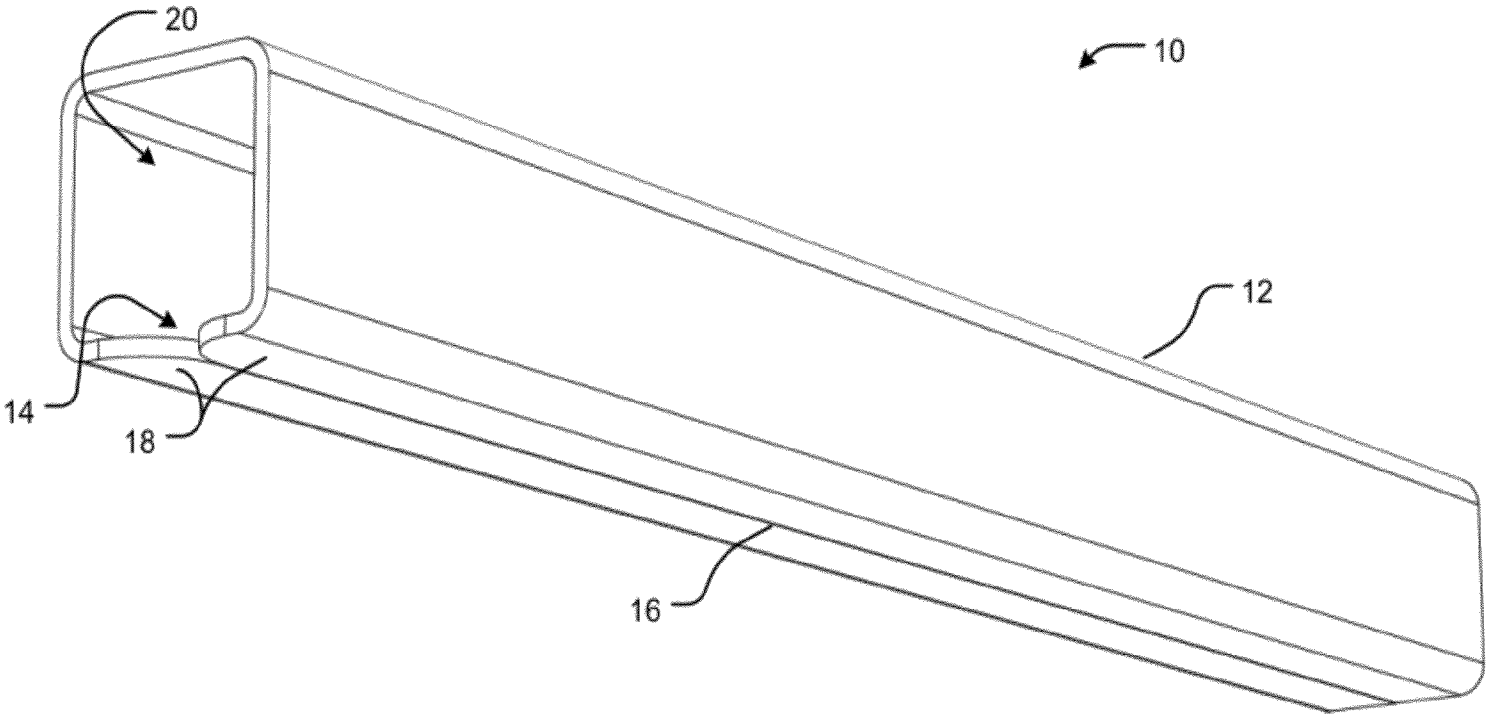
FIG. 1A is a perspective view of a resealable storage bag hanging device, in accordance with an embodiment of the present invention.
Figure 1B:
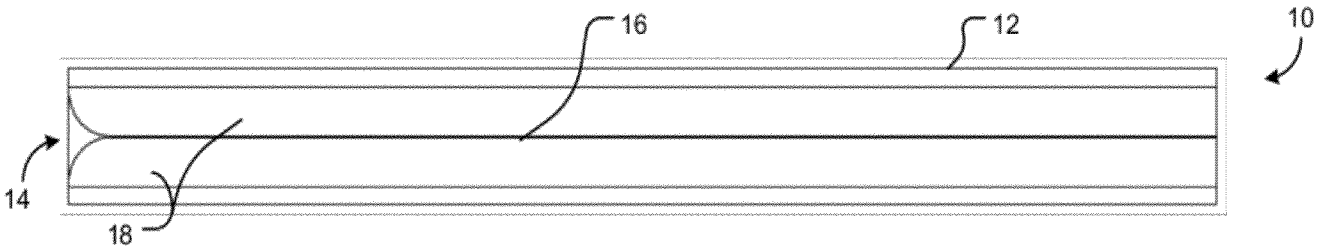
FIG. 1B is a bottom view of the resealable storage bag hanging device of FIG. 1A, in accordance with an embodiment of the present invention.
Figure 1C:
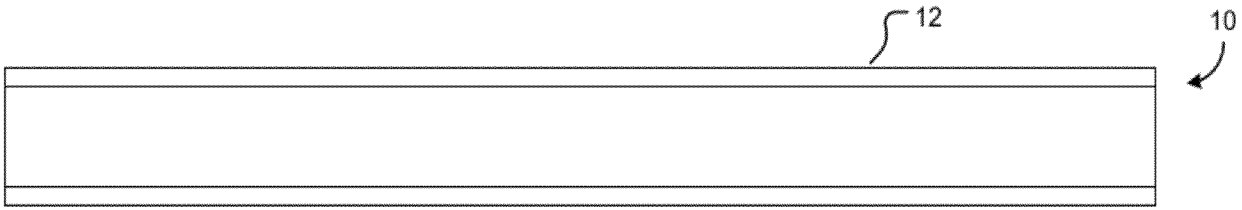
FIG. 1C is a side view of the resealable storage bag hanging device of FIG. 1A, in accordance with an embodiment of the present invention.
Figure 1D:
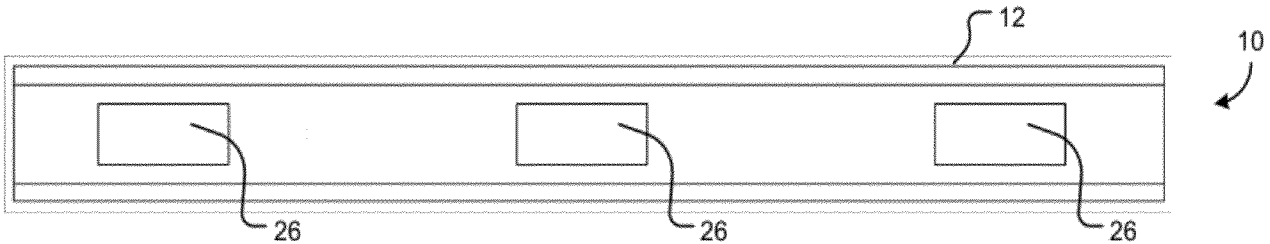
FIG. 1D is a top view of the resealable storage bag hanging device of FIG. 1A, in accordance with an embodiment of the present invention.
Figure 1F:
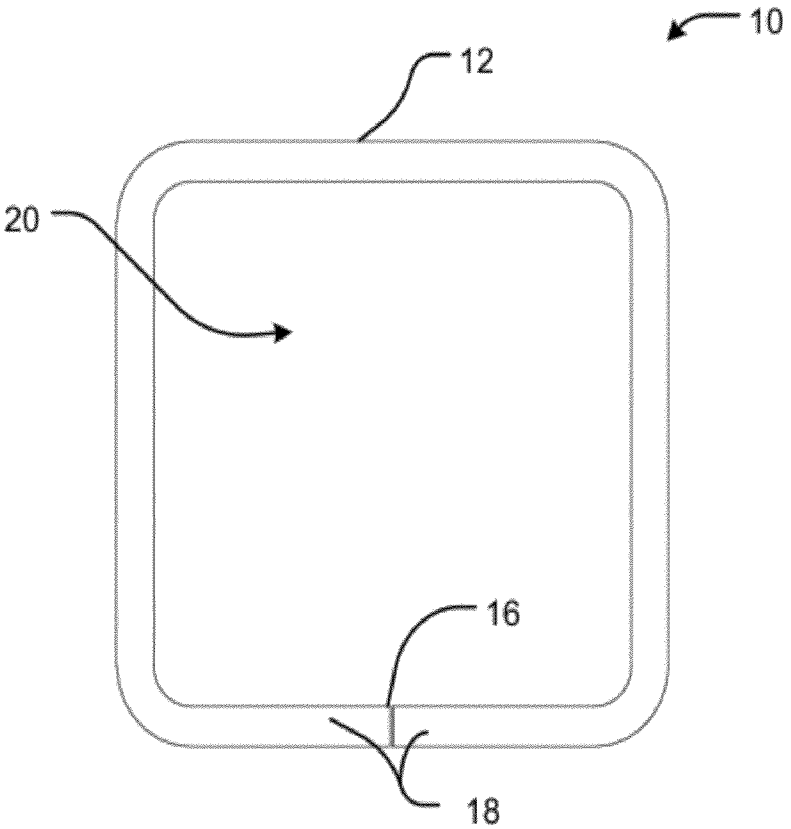
FIG. 1F is a rear view of the resealable storage bag hanging device of FIG. 1A, in accordance with an embodiment of the present invention.
Figure 1E:
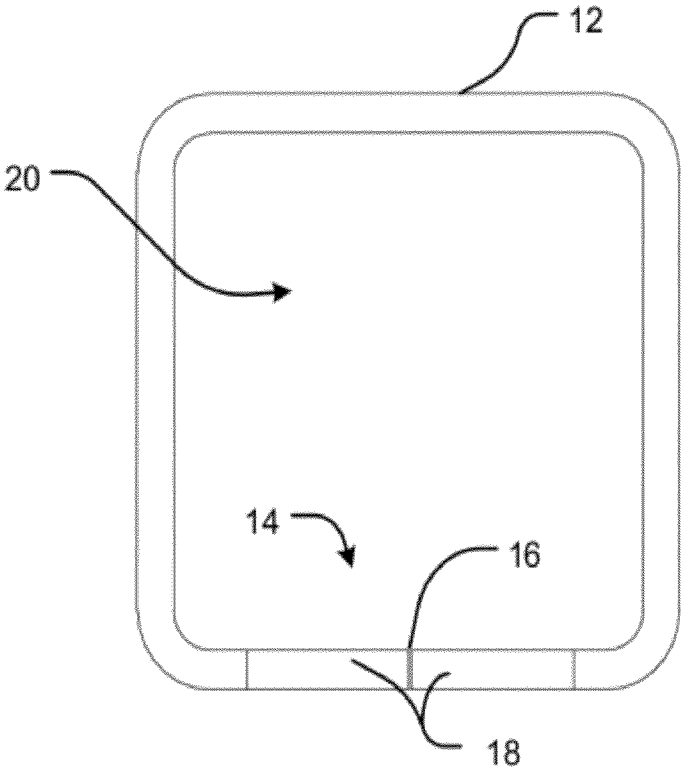
FIG. 1E is a front view of the resealable storage bag hanging device of FIG. 1A, in accordance with an embodiment of the present invention.
Figure 2A:
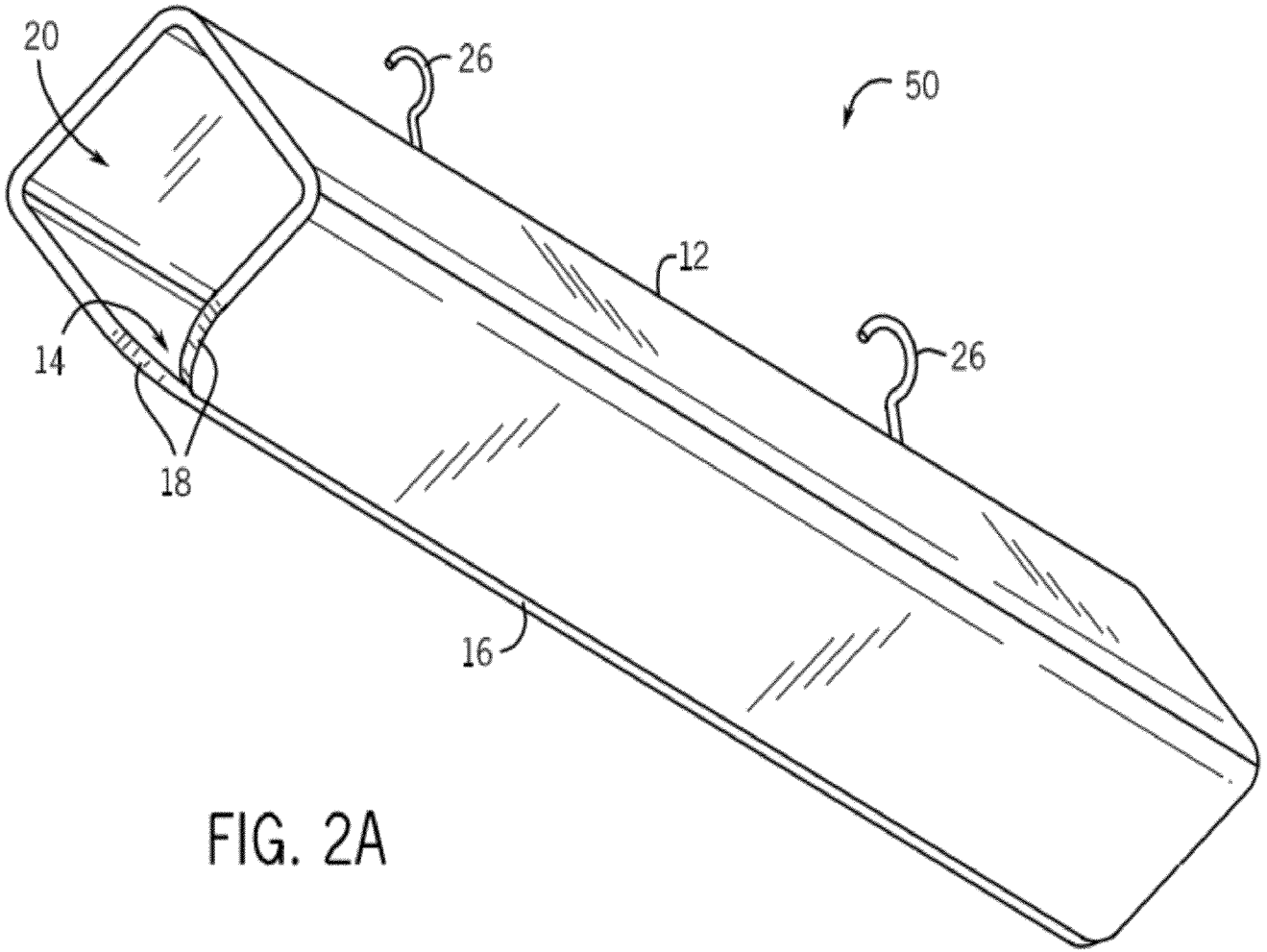
FIG. 2A is a perspective view of a resealable storage bag hanging device, in accordance with an embodiment of the present invention.
Figure 2B:
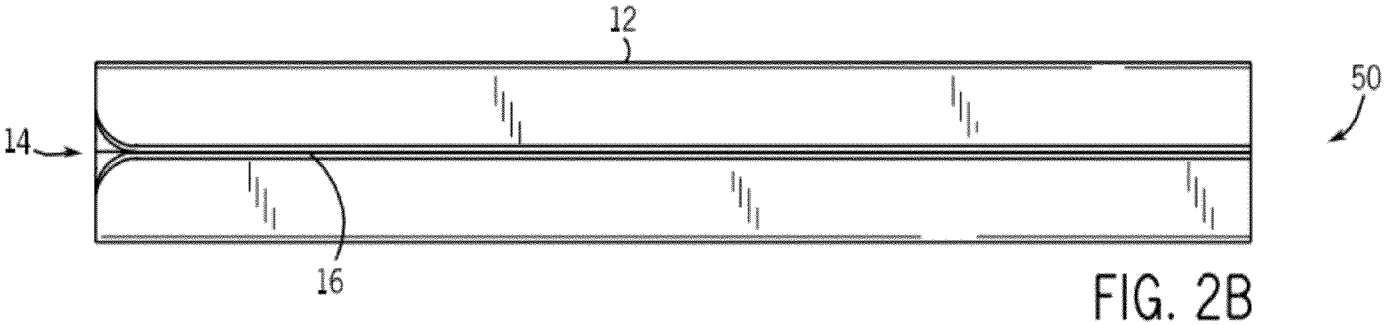
FIG. 2B is a bottom view of the resealable storage bag hanging device of FIG. 2A, in accordance with an embodiment of the present invention.
Figure 2C:
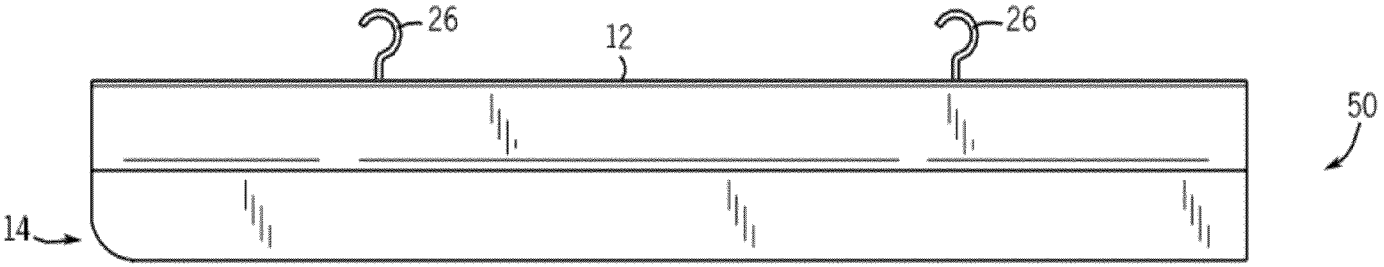
FIG. 2C is a side view of the resealable storage bag hanging device of FIG. 2A, in accordance with an embodiment of the present invention.
Figure 2D:
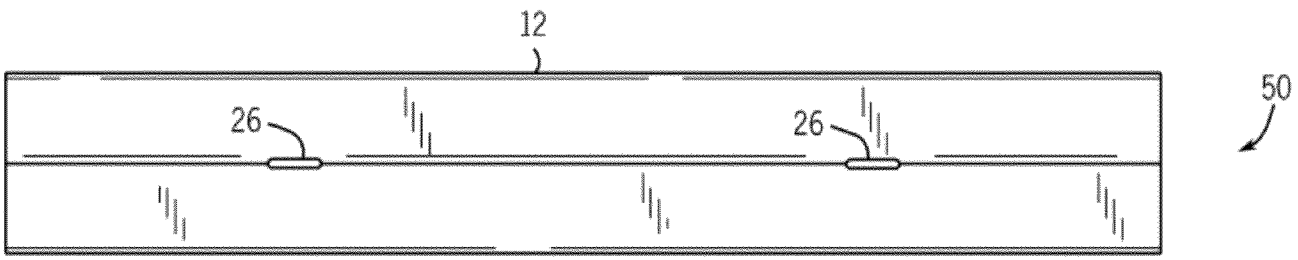
FIG. 2D is a top view of the resealable storage bag hanging device of FIG. 2A, in accordance with an embodiment of the present invention.
Figure 2F:
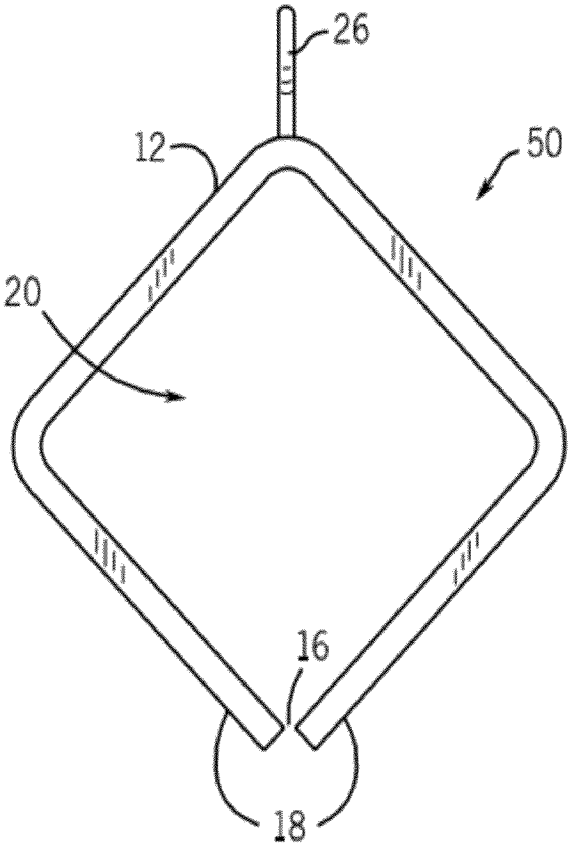
FIG. 2F is a rear view of the resealable storage bag hanging device of FIG. 2A, in accordance with an embodiment of the present invention.
Figure 2E:
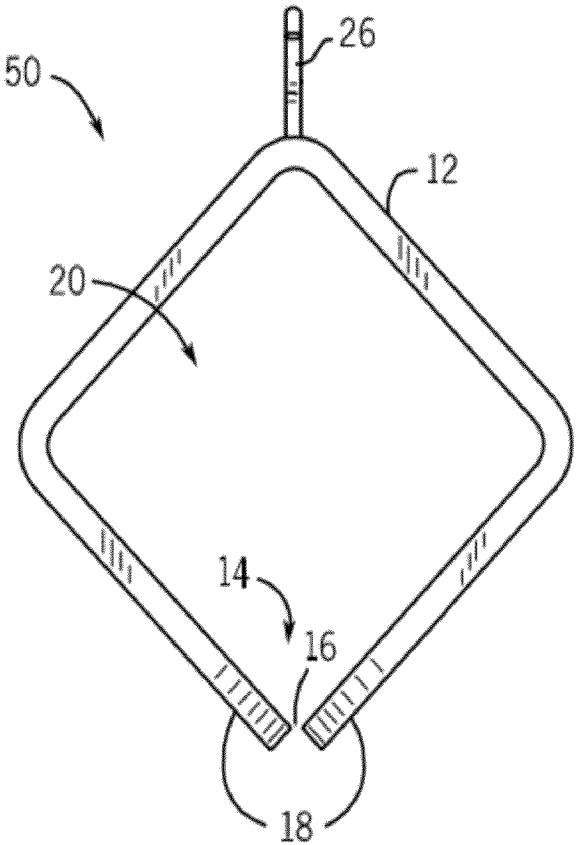
FIG. 2E is a front view of the resealable storage bag hanging device of FIG. 2A, in accordance with an embodiment of the present invention.

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known components have not been described in detail as not to unnecessarily obscure aspects of the present invention.

Briefly stated, embodiments provide for a device that allows for a resealable storage bags—and particularly those with mechanical storage means, such as a mechanical zipper—to be hung from virtually any flat surface, including but not limited to shelves in cupboards, pantries, refrigerators, freezers, etc. By hanging storage bags vertically, rather than laying them horizontally on a shelf, embodiments allow for efficient use of often unused vertical space above a shelf. This also frees up shelf or counter space for other items.

FIGS. 1A-1F and FIGS. 2A-2D respectively illustrate various views of alternative embodiments of hanging devices 10 and 50 for resealable storage bags, in accordance with various embodiments of the present invention. As shown, the hanging devices 10 and 50 each comprise a main body 12. In the illustrated embodiments, each body 12 is a hollow, elongate member that defines a channel 20 therethrough. The body 12 may be formed from plastic, aluminum, steel, or any other suitable material. The channel 20 should be large enough to accommodate a portion of a resealable storage bag 24 that includes the mechanical zipper 22 and above.

Each body 12 includes two longitudinal, opposing flaps 18, between which a narrow slit 16 passes. As shown in FIGS. 1A-1F, the opposing flaps 18 may be planarly aligned and together comprise one side (e.g. a bottom face) of the body 12, wherein the slit 16 is formed generally down the center of such side. Alternatively, as shown in FIGS. 2A-2F, the opposing flaps 18 may also be non-coplanar, such that the slit 16 is formed at an intersection between the opposing flaps. In both of the illustrated embodiments, at least one end of the body includes a tapered portion 14 that narrows into the slit 16. The slit 16 should be wide enough to permit the main body of a resealable storage bag 24 to pass therethrough without damaging the bag 24, yet narrow enough to prevent a mechanical zipper 22 of the bag 24 from falling through the slit 16, even when the bag 24 is storing heavy contents. To that end, the opposing flaps 18 should be sufficiently resilient to keep the bag 24 clamped and prevent the mechanical zipper 22 of the bag 24 from falling through the slit 16. The slit 16 is also preferably long enough to accommodate the entire length of the bag 24, but is not limited as such. In one embodiment, the slit 16 is long enough to accommodate multiple bags 24.

In one embodiment, the devices 10 and 50 may each include one or more attachment members 26 disposed on a side of the device 10 or 50, for attaching the device 10 or 50 to a surface. The attachment members 26 may include magnets, double-sided tape, an adhesive, a hook or hanger, or any other suitable means for attachment to the target surface. Although the attachment members 26 are shown as being disposed along the top of the devices 10 and 50, it will be appreciated that the attachment members can also be disposed on other sides of the devices 10 and 50 as well. Further, depending on the specific type of attachment members 26, the devices 10 and 50 may be removably attached to a surface.

In another embodiment, the devices 10 and 50 may be a feature that is molded into a surface, such as the underside of a refrigerator or cupboard shelf.

Figure 3:
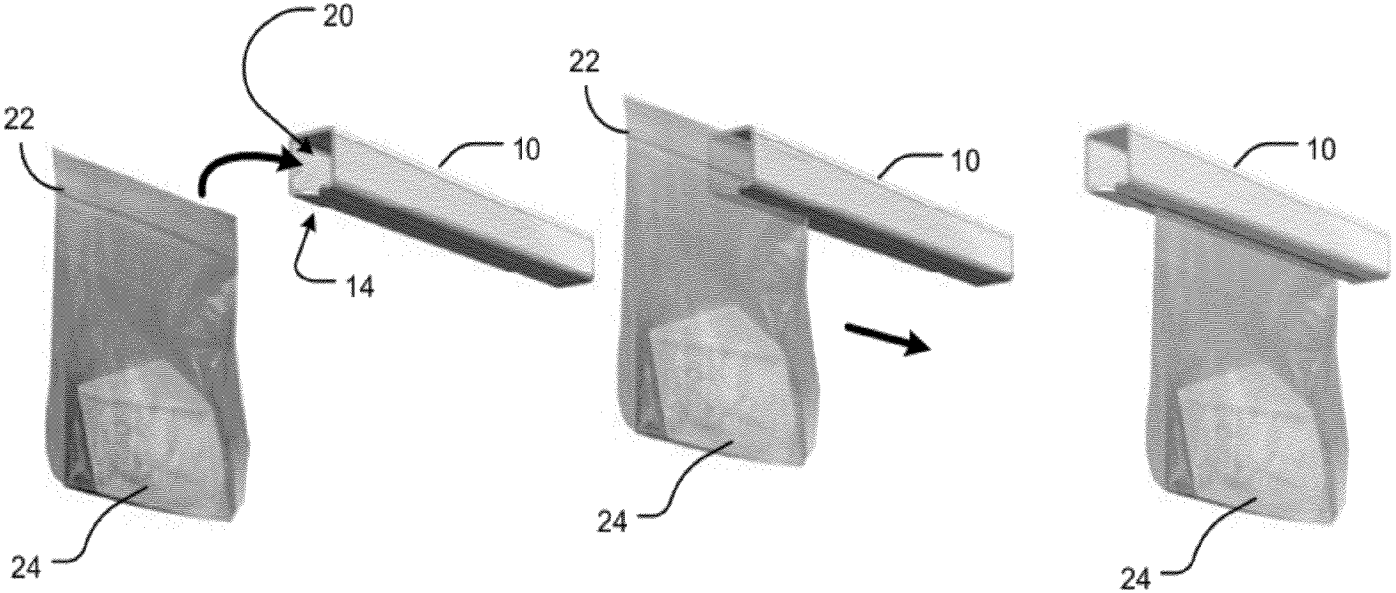
FIG. 3 illustrates a resealable storage bag being inserted into a hanging device according to an embodiment of the present invention.

FIG. 3 illustrates a resealable storage bag 24 being inserted into hanging device 10 according to an embodiment of the present invention. It will be appreciated that hanging device 50 may be used in much the same way. As shown, a leading edge of the bag 24 is inserted into the tapered opening 14 of the slit 16. The bag 24 is inserted so that the mechanical zipper 22 is inserted above the opposing flaps 18 and into the channel 20. Once the bag 24 is inserted, the opposing flaps cooperate with the mechanical zipper 22 to hold the bag 24 in place vertically.

FIG. 4, FIGS. 5A-B and FIGS. 6A-B respectively illustrate various views of additional alternative embodiments of hanging devices 60, 70 and 80 for resealable storage bags, in accordance with various embodiments of the present invention. As shown, the hanging device 60, 70 and 80 each comprise two opposing members 62 and 64. As shown in FIGS. 5A-B and FIGS. 6A-B, one of the opposing members 62 and 64 may be formed by a surface to which the device is attached. In the illustrated embodiments, the opposing members 62 and 64 are connected at a joint 66, which allows the opposing members 62 and 64 to move relative to one another into open and clamped positions, creating a variably shaped opening 68. When opposing members 62 and 64 are in the open position, opening 68 expands. When opposing members 62 and 64 are in the clamped position, opening 68 becomes smaller. In the clamped position, opening 68 should be wide enough to accommodate the main body of a resealable storage bag 24 without damaging the bag 24, yet narrow enough to prevent a mechanical zipper 22 of the bag 24 from falling through the opening 68. To that end, the opposing members 62 and 64 should be sufficiently resilient to keep the bag 24 clamped and prevent the mechanical zipper 22 of the bag 24 from falling through the opening 68. The opposing members 62 and 64 are also preferably long enough to accommodate the entire length of the bag 24, but are not limited as such. In various embodiments, the opposing members 62 and 64 are long enough to accommodate multiple bags 24.

Figure 4:
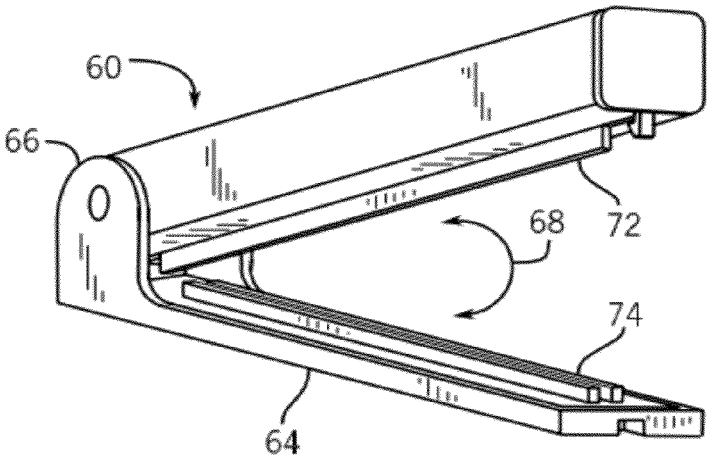
FIG. 4 is a perspective view of a resealable storage bag hanging device, in accordance with an embodiment of the present invention.
Figure 5A:
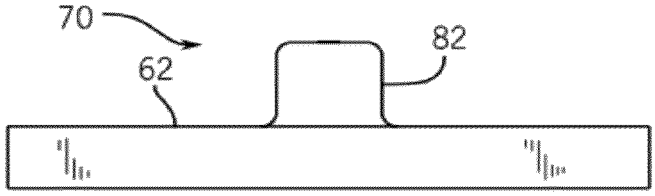
FIG. 5A is a top view of a resealable storage bag hanging device, in accordance with an embodiment of the present invention.
Figure 5B:
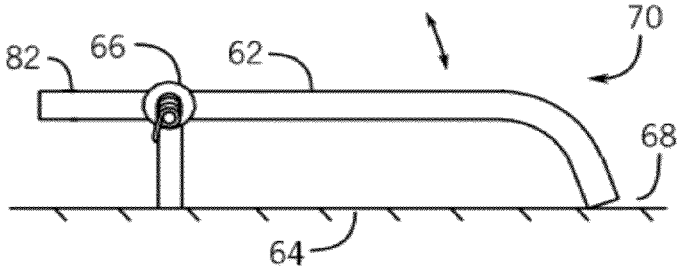
FIG. 5B is a side view of the resealable storage bag hanging device of FIG. 5A, in accordance with an embodiment of the present invention.
Figure 6A:
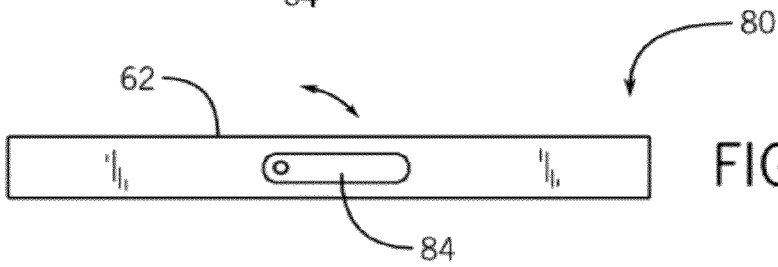
FIG. 6A is a top view of a resealable storage bag hanging device, in accordance with an embodiment of the present invention.
Figure 6B:
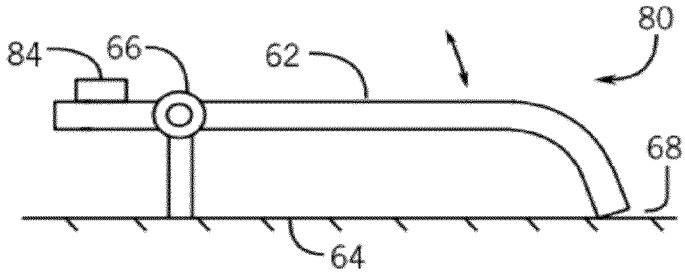
FIG. 6B is a side view of the resealable storage bag hanging device of FIG. 6A, in accordance with an embodiment of the present invention.

As shown in FIG. 4, the illustrated device 60 may include mating elements 72 and 74 disposed on the intersecting surfaces of opposing members 62 and 64, for clamping the resealable storage bag 24 more securely. While not similarly depicted in FIGS. 5A-6B, it will be appreciated that similar mating elements 72 and 74 may be used with devices 70 and 80.

As shown in FIGS. 5A-B and 6A-B respectively, the opening and closing of opposing members 62 and 64 may be controlled by a handle 82 and 84, wherein pressing or pushing on the handles 82 and 84 will cause opposing members 62 and 64 to open, while releasing the handles 82 and 84 will cause opposing members 62 and 64 to close, thereby applying a clamping force on a subject storage bag 24 (not shown). Again, the force applied by the opposing members 62 and 64 should be sufficient to securely hold the storage bag 24 without damaging it.

In one embodiment, the devices 60, 70 and 80 may include one or more attachment members 26 (not shown) disposed on a side of devices 60, 70 and 80, for attaching devices 60, 70 and 80 to a surface—preferably a vertical surface. The attachment members 26 may include magnets, double-sided tape, an adhesive, a hook or hanger, or any other suitable means for attachment to the target surface. It will be appreciated that the attachment members 26 can also be disposed on various sides of the devices 60, 70 and 80. Further, depending on the specific type of attachment members, the attachment members 26 may be removably attached to a surface.

FIG. 7A-B, FIGS. 8A-C, and FIGS. 9A-C illustrate embodiments of the present invention, wherein a plurality of hanging devices 10 are arranged in various configurations to form various systems of hanging devices 100, 200 and 300. It will be appreciated that hanging devices 50, 60, 70 and 80 may be used in much the same way in alternative systems. Each hanging device 10 is attached to at least one common attachment member 94 by means of attachment elements 92. In one embodiment, the attachment elements 92 may be hinges. In another embodiment, the attachment elements 92 may be ratcheting joints.

As shown in FIG. 7A-B, in system 100, the hanging devices 10 may be arranged in a horizontal alignment, hanging devices 10 are independently affixed to various attachment elements 92 on a single horizontal surface 94. In system 100, the various attachment elements 92 are arranged such that their respective axes are generally vertically parallel, and each hanging device 10 rotates on a separate axis. Additionally, the hanging devices 10 rotate at the attachment elements 92, allowing the user to browse, or flip through the resealable bags 24. When the bags 24 are not being browsed, they can all be pushed to one side, thereby conserving space.

Figure 8A:
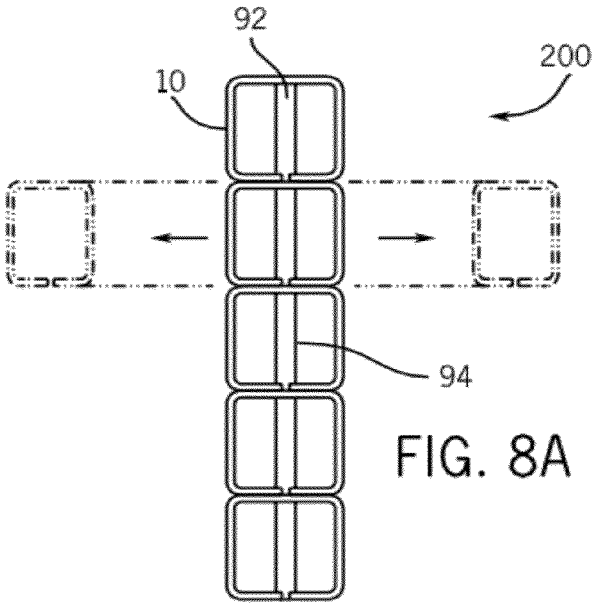
FIG. 8A is a front view of a resealable storage bag hanging system, in accordance with an embodiment of the present invention.
Figure 8B:
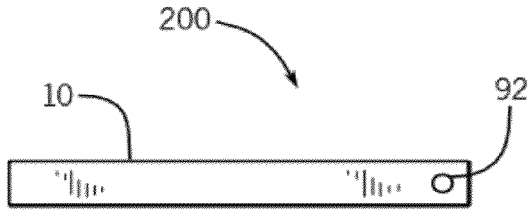
FIG. 8B is a top view of the resealable storage bag hanging system of FIG. 8A, in accordance with an embodiment of the present invention.
Figure 8C:
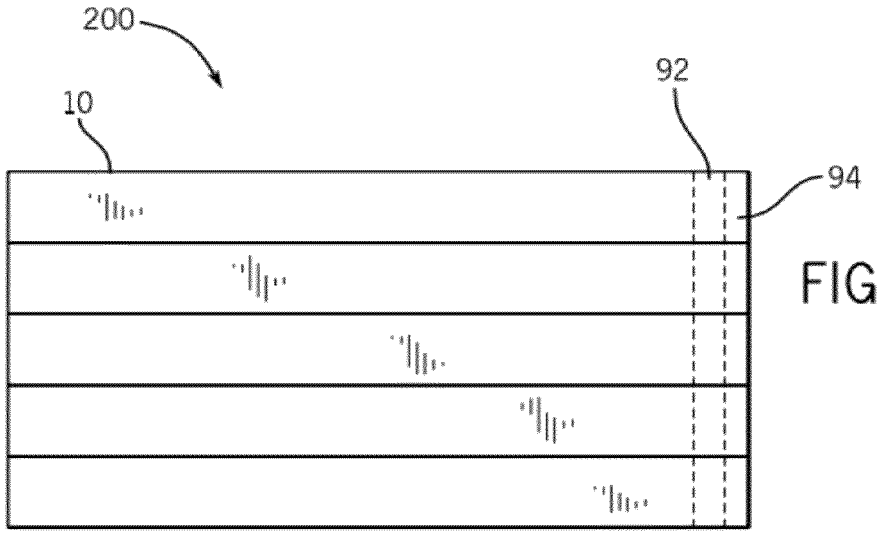
FIG. 8C is a side view of the resealable storage bag hanging system of FIG. 8A, in accordance with an embodiment of the present invention.

Alternatively, FIGS. 8A-C show that the hanging devices 10 of system 200 may be arranged in a vertical alignment, wherein various attachment elements 92 affix each hanging device 10 to a common vertical surface 94. The various attachment elements are vertically aligned and the devices 10 rotate on a substantially common axis. The resealable bags 24 thus hang above and below one another. When not in use, the devices 10 may be stacked so they are substantially vertically aligned, in a space conserving configuration. Additionally, a user may rotate the devices 10 upon their shared axis, creating a fan-like configuration.

Figure 9A:
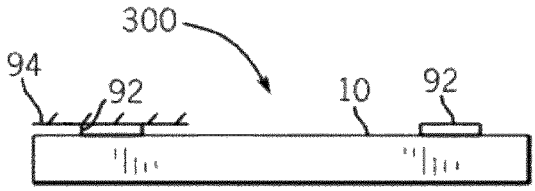
FIG. 9A is a side view of a resealable storage bag hanging system, in accordance with an embodiment of the present invention.
Figure 9B:
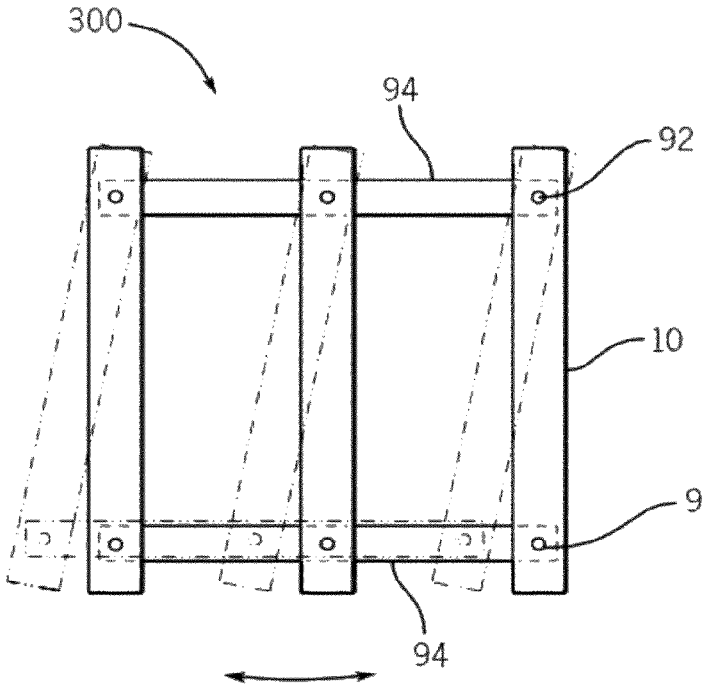
FIG. 9B is a top view of the resealable storage bag hanging system of FIG. 9A in an open position, in accordance with an embodiment of the present invention.
Figure 9C:
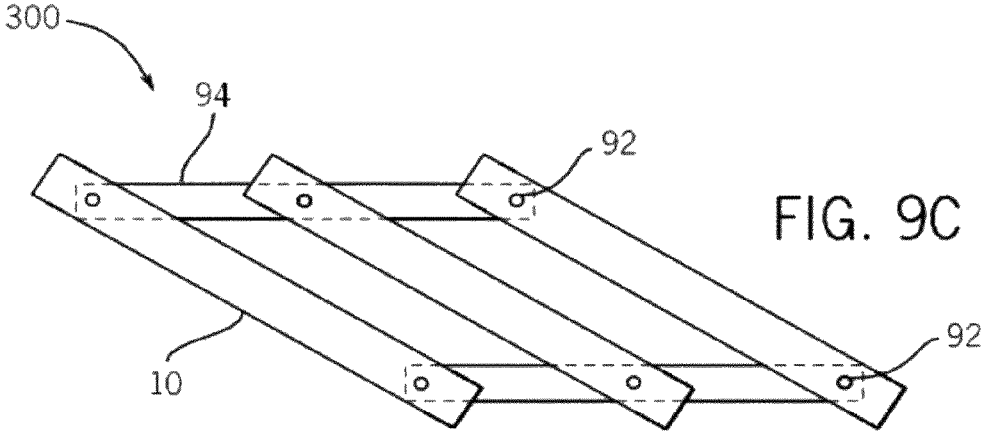
FIG. 9C is a perspective view of the resealable storage bag hanging system of FIG. 9A in a folded position, in accordance with an embodiment of the present invention.

As shown in FIG. 9A-C, the system 300 may include two or more attachment members 94 attached to each hanging device 10. The hanging devices 10 may be attached to the attachment elements 94 by two or more attachment points 92. As shown in FIG. 9A, one of the attachment elements 92 may be attached to a surface. In the illustrated embodiment, a first attachment member 94 remains fixed, while a second attachment member 94 is movable. As the second attachment member 94 moves, it remains parallel with the first attachment member 94, maintaining a parallelogram shape. FIG. 9B shows the system 300 in an open position while FIG. 9C shows the system 300 in a closed position. System 300 creates a stable yet flexible system for arranging resealable bags 24.

Thus, embodiments provide for hanging devices that allow for resealable storage bags to be hung from virtually any flat surface. By utilizing a hanging device according to an embodiment, a consumer is able to better maximize his or her storage space in his or her home. Further, embodiments provide for various storage systems comprising a plurality of hanging devices, which allow users to better organize his or her resealable bags and further maximize his or her storage space.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A device for hanging a storage bag having a resealable mechanical seal, the device, comprising:

an elongate body comprising:

at least two opposing flaps;

a longitudinal slit passing a distance between the opposing flaps, the slit having a width that is narrower than the mechanical seal of the storage bag;

a tapered opening positioned at an edge of the body opening adapted to guide a leading edge of the storage bag that is below the mechanical seal into the slit; and wherein the opposing flaps are non-planarly aligned and the slit is formed at the intersection of the opposing flaps.

2. The device as recited in claim 1 wherein the opposing flaps keep the storage hag clamped and prevent the mechanical seal from passing down through the slit, thereby preventing the food storage bag from falling.

3. The device as recited in claim 1 wherein the opposing flaps are resilient to provide a clamping force.

4. The device as recited in claim 1 wherein the body comprises a plastic material.

5. The device as recited in claim 1 wherein at least one side of the body includes one or more magnets for enabling securement of the device to a metallic surface.

6. The device as recited in claim 1 wherein at least one side of the body includes an adhesive for enabling securement of the device to a flat surface.

7. The device as recited in claim 1 wherein at least one side of the body includes a hook for removably attaching the device to a surface.

8. The device as recited in claim 1 wherein the body and the slit are sufficiently long enough for the slit to accommodate multiple storage bags.

9. The device as recited in claim 1 wherein the body is substantially hollow.

10. A system for hanging a plurality of storage bags having resealable mechanical seals, the system comprising:

a common attachment member having a plurality of attachment elements disposed along a length thereof, and a plurality of hanging devices coupled with the common attachment member at the attachment elements, each of the hanging devices comprising:

an elongate body comprising:

at least two opposing flaps;

a longitudinal slit passing a distance between the opposing flaps, the slit having a width that is narrower than the mechanical seal of the storage bag;

a tapered opening positioned at an edge of the body opening adapted to guide a leading edge of the storage bag that is below the mechanical seal into the slit; and wherein the opposing flaps are non-planarly aligned and the slit is formed at the intersection of the opposing flaps.

11. The system as recited in claim 10, wherein the attachment elements are arranged such that the hanging devices pivot around a substantially common axis.

12. The system as recited in claim 10, wherein the attachment elements are arranged such that the hanging devices pivot around a plurality of generally parallel axes.

13. The system as recited in claim 10, wherein the system comprises a first common attachment member and a second common attachment member, wherein the first common attachment member is coupled to a first end of the hanging devices, and wherein the second common attachment member is coupled to a second end of the hanging devices.

14. The system as recited in claim 13 wherein the first common attachment member and the second common attachment member are generally parallel.

* * * * *